US009338537B2

(12) United States Patent
Kircher

(10) Patent No.: US 9,338,537 B2
(45) Date of Patent: May 10, 2016

(54) LOUDSPEAKER HOUSING

(71) Applicant: Michael Kircher, Mitterteich (DE)

(72) Inventor: Michael Kircher, Mitterteich (DE)

(73) Assignee: FUEHLKLANG AG, Mitterteich (DE)

( * ) Notice: Subject to any disclaimer, the term of this patent is extended or adjusted under 35 U.S.C. 154(b) by 0 days.

(21) Appl. No.: 14/365,397

(22) PCT Filed: Dec. 14, 2012

(86) PCT No.: PCT/EP2012/075658
§ 371 (c)(1),
(2) Date: Jun. 13, 2014

(87) PCT Pub. No.: WO2013/087900
PCT Pub. Date: Jun. 20, 2013

(65) Prior Publication Data

US 2014/0301594 A1 Oct. 9, 2014

(30) Foreign Application Priority Data

Dec. 14, 2011 (DE) ..... 10 2011 056 428

(51) Int. Cl.
*H04R 9/06* (2006.01)
*H04R 1/02* (2006.01)
*H04R 1/28* (2006.01)

(52) U.S. Cl.
CPC ..... *H04R 1/025* (2013.01); *H04R 1/2819* (2013.01); *H04R 1/2888* (2013.01)

(58) Field of Classification Search
CPC ..... H04R 1/02; H04R 1/28; H04R 1/2807; H04R 1/30; H04R 1/2861; H04R 1/2865; H04R 1/2869; H04R 1/2873; H04R 1/2876; H04R 2460/13; H04R 1/1016
USPC ..... 381/333–336, 337–341, 345, 353–354, 381/380
See application file for complete search history.

(56) References Cited

U.S. PATENT DOCUMENTS 3,482,063 A * 12/1969 Day ..... 381/340
3,890,475 A * 6/1975 Denhart ..... 381/336

(Continued)

FOREIGN PATENT DOCUMENTS

EP 2 040 483 A2 3/2009
FR 1201682 A 1/1960

(Continued)

OTHER PUBLICATIONS

Written Opinion of the International Searching Authority issued in PCT/EP2012/075658 with English translation dated Feb. 19, 2013 (15 pages).

(Continued)

*Primary Examiner* — Suhan Ni
(74) *Attorney, Agent, or Firm* — Flynn, Thiel, Boutell & Tanis, P.C.

(57) ABSTRACT

The invention relates to a loudspeaker and to a loudspeaker housing for accommodating a loudspeaker module, wherein the loudspeaker housing has a sound output side having a sound output opening and a casing, wherein the sound output side is the side of the loudspeaker housing that is intended to output the sound of the loudspeaker module through the sound output side when the loudspeaker module is arranged in the loudspeaker housing, wherein the sound output direction is perpendicular to the sound output side, and wherein the casing is arranged radially around the sound output direction and laterally around the sound output side, and wherein the loudspeaker housing has a rear side opposite the sound output side, and wherein the rear side is open or has an opening, wherein between the sound output side and the rear side, the casing varies in the cross-section thereof perpendicular to the distance line between the sound output side and the rear side.

12 Claims, 4 Drawing Sheets

(56) References Cited

U.S. PATENT DOCUMENTS

| | | | | |
|---|---|---|---|---|
| 4,865,153 | A * | 9/1989 | Toyoda | 381/336 |
| 5,286,928 | A | 2/1994 | Borland | |
| 6,377,696 | B1 * | 4/2002 | Nevill | 381/345 |
| 6,731,772 | B1 * | 5/2004 | Byun | 381/380 |
| 7,054,457 | B2 * | 5/2006 | Saltykov | 381/380 |
| 9,042,588 | B2 * | 5/2015 | Aase | 381/380 |

FOREIGN PATENT DOCUMENTS

| | | | |
|---|---|---|---|
| WO | WO 98/31185 | A2 | 7/1998 |
| WO | WO 2005/029917 | A1 | 3/2005 |

OTHER PUBLICATIONS

Internet Article "Hifi World Stuttgart" May 11, 2011-Jun. 11, 2011, XP055052760, (4 pages) URL:http//www.hifi-music-world.de/index.php/messeinformationen.

Internet Article "Fuehlklang Musikaesthetik" Nov. 23, 2011, XP055052584 (2 pages) URL:http://web.archive.org/web/20111123234638/http://fuehlklang.de/.

Internet Article "DIY-HIFI-Forum" Oct. 11, 2010, XP055052598, (2 pages) URL:http://www.diy-hifi-forum.eu/forum/showthread.php?p-27818.

Form PCT/ISA/210 International Search Report issued in International Application No. PCT/EP2012/075658 with English translation, date of mailing Feb. 19, 2013 (7 pages).

* cited by examiner

LOUDSPEAKER HOUSING

BACKGROUND OF THE INVENTION

1. Field of the Invention

The invention relates to a loudspeaker and to a loudspeaker housing for accommodating a loudspeaker module, wherein the loudspeaker housing has a sound output side having a sound output opening and a casing, wherein the sound output side is the side of the loudspeaker housing that is intended to output the sound of the loudspeaker module when the loudspeaker module is arranged in the loudspeaker housing, wherein the sound output direction is perpendicular to the sound output side, and wherein the casing is arranged radially around a direction opposite the sound output direction and laterally around the sound output side, and wherein the loudspeaker housing has a rear side opposite the sound output side.

2. Prior Art

Loudspeakers for playback of tones, noises, sounds and the like have been known for a long time. Usually, the loudspeakers have a loudspeaker housing and a loudspeaker module, which is arranged in the loudspeaker housing. The loudspeaker module serves to actually convert the electrical signals into sound, while the loudspeaker housing serves the purpose of arrangement of the loudspeaker module and sound transmission.

The loudspeaker modules are usually configured as so-called surface emitters in which corresponding diaphragms are provided for converting the electrical signals into sound. In accordance with the way the loudspeaker module is mounted in the loudspeaker housing, a distinction is drawn between front and rear mounting.

In a front mounting of the loudspeaker module, which is also referred to as the loudspeaker chassis, the loudspeaker module is arranged with the sound-emitting diaphragm facing towards and at the sound output side of the loudspeaker housing, such that the sound emanates from the loudspeaker housing directly from the front (sound output direction). However, sound is emitted not only to the front, but additionally to the rear, i.e. opposite to the sound output direction. The housing surrounding the loudspeaker module forms in this regard a so-called baffle which prevents an acoustic short circuit between the sound output to the front and to the rear.

Loudspeaker housings can be further divided into open loudspeaker housings, which have an open rear side, such as bass reflex tubes, and sealed housings.

In an open housing with front mounting of the loudspeaker module, the sound-producing diaphragm is arranged on the sound output side of the housing and/or an opening provided therein, wherein the side opposite, i.e. the rear side, is open. The baffle is formed by the casing of the loudspeaker housing that surrounds the sound output side. In order to achieve maximum efficiency of the loudspeaker with the lowest-possible lower limit frequency combined with minimum housing volume, compromises must be made, as these desirable properties require partially contradictory measures.

DISCLOSURE OF THE INVENTION

Object of the Invention

It is therefore an object of the present invention to provide a loudspeaker housing or a loudspeaker to help improve and optimise the property profile of loudspeakers. At the same time, the loudspeaker and/or the loudspeaker housing should be of simple construction and have a pleasant appearance. Furthermore, simple and efficient ease of manufacture is desirable.

Technical Solution

This object is achieved by a loudspeaker housing having the characteristics of claim 1 and a loudspeaker having the characteristics of claim 14 and a method of manufacturing a loudspeaker having the characteristics of claim 15. Advantageous embodiments are the object of the dependent claims.

The invention proposes to configure an open loudspeaker housing with front mounting in such a way that the casing between a sound output side and the rear side of the loudspeaker housing varies in cross-section, which extends perpendicularly to a corresponding connecting line extending between the sound output side and the rear side. The rearward-emitted sound of the open loudspeaker housing with front mounting is correspondingly modified in this way. As a result, a precisely defined radiation resistance of the emission and better room coupling of the loudspeaker chassis to the air in the listening room can be adjusted. By making appropriate enlargements or reductions to the housing, various other parameters can be changed in addition to the setting of the lowest emittable frequency, such as the phasing of the rearward-emitted sound with respect to the sound emitted at the sound output side of the loudspeaker chassis. As a result, phasing, impulse response, step response, frequency response and efficiency of the loudspeaker are optimised. Through the variation in dimension and/or shape of the casing, the rearward-emitted sound is output over a broad band towards the rear as well, such that it is not only one section of the frequency spectrum which is emitted to the rear. In addition, there is less acoustic excitation of the housing through the loudspeaker housing and the loudspeaker housing can work effectively in the entire audible frequency range, wherein standing waves, room resonance, flutter echoes or housing resonance can be largely avoided or minimised.

The casing here can be provided such that it extends like a cylinder or in a curve around the sound output side or around a line opposite the sound output direction.

The distance between the sound output side and the rear side can be larger than the largest diameter of the casing perpendicular to the corresponding distance line, such that the longitudinal axis of the loudspeaker housing runs between sound output side and the rear side.

The casing can especially vary in diameter along the longitudinal axis.

According to one embodiment, the casing between the sound output side and rear side can have several sections, in particular, three sections, wherein the first section can be a barrel-shaped section, the second section, a tapered section in the shape of a hyperboloid, and the third section, a conical expansion section. By barrel shape is meant a cylinder-like shape in which the circular cross-section of the cylinder varies along the longitudinal axis of the cylinder, more precisely, widening from a first end face and then narrowing again toward the opposite end face.

The conical expansion section can in particular be formed such that the housing opens or expands conically towards the rear side.

The hyperboloidally tapered section can be arranged between the barrel-shaped section of the sound output side and the conical expansion section at the rear side. The transitions between the sections can be continuous and/or seamless, such that the loudspeaker housing has largely no edges and corners.

The loudspeaker housing can be curved along its longitudinal axis, that is, the longitudinal axis has a curvature. The longitudinal axis in this regard is defined in such a way that the longitudinal axis in those cross-sections which are perpendicular to the longitudinal axis forms the centre in each case along the longitudinal extension, i.e. has an even spacing from the casing or the geometric centre of gravity in different directions. In particular, the longitudinal axis can thus be arranged in the centre of circular cross-sections of the loudspeaker housing, wherein the circular cross-sections run perpendicular to the longitudinal extension.

The curvature of the loudspeaker housing gives rise in particular to an inclined arrangement of the opening plane of the opening at the rear side relative to the opening plane of the opening of the sound output side, wherein the respective planes can have an acute angle greater than 0° and less than or equal to 90°, in particular greater than or equal to 5° and less than or equal to 30°.

In this connection, an especially asymmetric merging of the sound of the outer and inner sound and/or of the forward-emitted sound and of the rearward-emitted sound of the loudspeaker chassis, such that the sound-reinforcing property of the loudspeaker housing is present over a wide frequency range.

The loudspeaker housing can be configured so as to be smooth and/or textured on the insides, wherein smooth, inner surfaces lead to amplifying of the sound level and resonances in different frequency ranges, while roughened or textured inner surfaces lead to a balancing and/or "smearing" of the frequency increases and cancellations.

The housing can be formed of plastic, carbon-fibre-reinforced plastic, or plastic with natural additives, in particular of organic or inorganic materials. For example, organic additives such as wood, bamboo, hemp, and the like, and mineral additives such as rock crystal powder or rose quartz powder can be provided. Also, production entirely from natural materials, or of natural composites, such as, e.g., organic materials combined with natural binders, such as wood chips, natural fibres, and the like can be used.

The inventive loudspeaker therefore concerns a loudspeaker with front mounting, i.e. one in which the loudspeaker module is arranged on the sound output side and/or at a corresponding opening. Since the opening can comprise the entire surface of the sound output side, and thus the loudspeaker module can also cover the entire opening, the described housing shape of the loudspeaker housing can improve the forward-emitting behaviour, as said behaviour is not impaired by conventional baffles.

A corresponding loudspeaker housing and/or a corresponding loudspeaker can be produced such that the dimensions and/or the shape of the loudspeaker housing can be chosen such that the desired characteristics of the loudspeaker can be adjusted. This includes, e.g. the choice of the corresponding dimensions for the individual housing sections, such as the barrel-shaped section, the tapered section and the conical expansion section, as well as the choice of the corresponding surfaces for the inside of the housing, i.e. with or without texturing.

BRIEF DESCRIPTION OF THE FIGURES

The attached drawings show here in purely schematic form in

EMBODIMENTS

Further advantages, characteristics and features of the present invention are apparent from the following detailed description of embodiments using the enclosed drawings. However, the invention is not limited to these embodiments.

Figure 1:
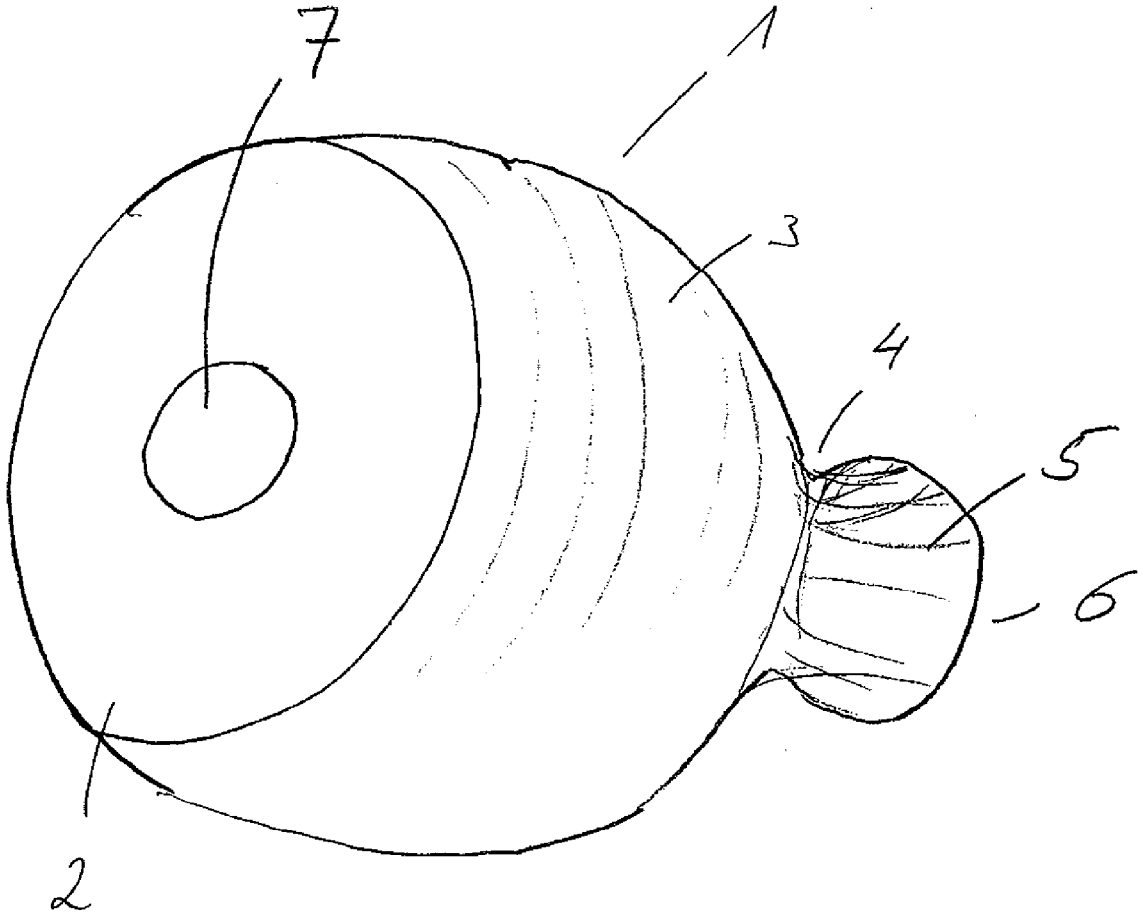
FIG. 1 a perspective view of a first embodiment of an inventive loudspeaker.

FIG. 1 shows a perspective view of a first embodiment of an inventive loudspeaker 1. The loudspeaker housing comprises a sound output side 2 and a casing 3, 4, 5 and a rear side 6. Provided in the sound output side 2 is an opening 7 behind which is arranged a loudspeaker module (not shown) such that the main output direction (sound output direction) of the sound is through the opening 7, i.e. the loudspeaker diaphragms face the opening 7.

The casing 3, 4, 5, which surrounds the sound output side 2 and which also encloses the loudspeaker module, has a barrel-shaped section 3, adjacent to the sound output side 2, a tapered section 4 and a conical expansion section 5. The barrel-shaped section 3 has a substantially cylindrical basic shape wherein, for the purpose of forming the barrel shape, the diameter widens initially and then narrows along a direction perpendicular to the sound output side so as to form a constriction in the tapered section 4. In the expansion section 5, the loudspeaker housing opens rearwards, wherein the rear side 6 has an opening or is formed by an opening, such that sound is output not only via the sound output side, but additionally via the rear side 6, which facilitates free access to the cavity formed by the barrel-shaped section 3 and the tapered section 4.

Figure 2:
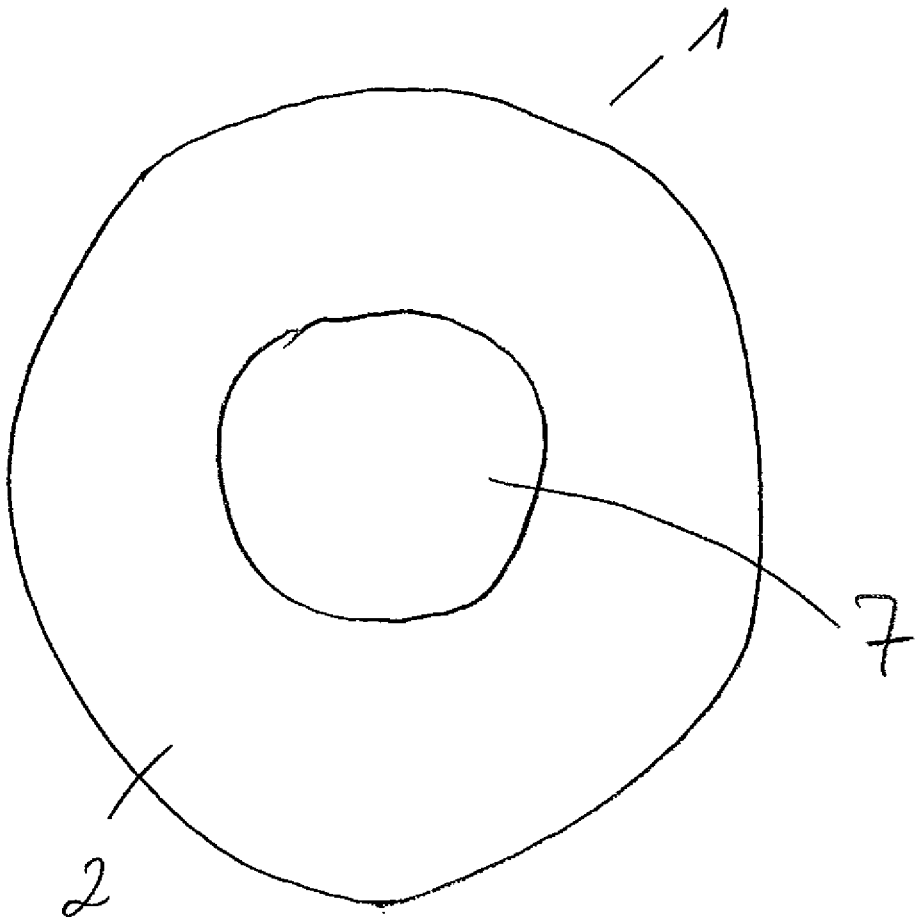
FIG. 2 a side view of a second embodiment of a loudspeaker.

FIG. 2 shows a plan view of the sound output side 2, which in turn has an opening 7, which, in this embodiment however, is larger than the diameter of the sound output side 2, both absolutely and relatively.

Figure 3:
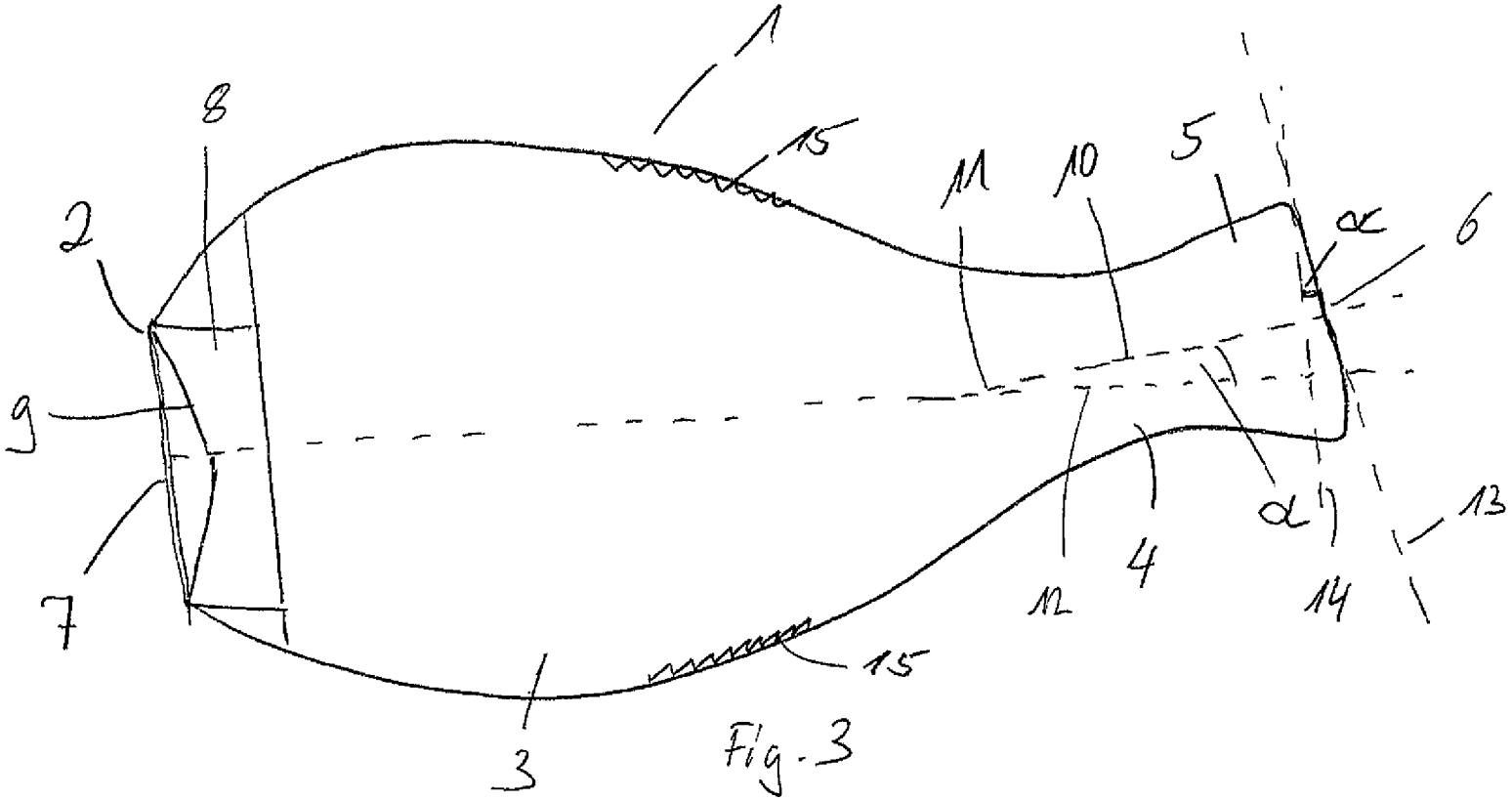
FIG. 3 a cross-sectional view through a third embodiment of an inventive loudspeaker; and in FIG. 4 a side view of a fourth embodiment of the inventive loudspeaker.

FIG. 3 shows a cross-section through a further embodiment of an inventive loudspeaker 1, in which in turn a sound output side 2 is provided which has an opening 7 which spans the entire sound output side 2. Provided on the sound output side 2 is a loudspeaker module 8 with corresponding diaphragms 9 for producing the sound.

Contiguous to the loudspeaker module 8 is the cavity formed by the barrel-shaped section, wherein, on the inside of the barrel-shaped section 3 are attached or implemented therein some structures 15 to the surface of the inside of the housing. The corresponding structures 15 can not only, as shown in the embodiment of FIG. 3, be arranged over a portion of the inner surface of the loudspeaker housing, but also throughout the whole interior of the loudspeaker housing. The structures 15 can be a wide variety of surface shapes, which are arranged on the inside of the loudspeaker housing or incorporated therein by machining of the inside thereof. In particular, the structures 15 can be present not just in the region of the barrel section, but also equally in the tapered section 4 and in the conical expansion section. The structures can have dimensions ranging from a few nanometres to millimetres and in particular be formed by roughened surfaces or other appropriate measures.

In the embodiment of FIG. 3, the loudspeaker housing in the region of the transition from the barrel-shaped section 3 to the hyperboloidal, tapered section 4 is furthermore curved such that the rear side 6 and/or the plane of the opening of the rear side 6 is arranged at an acute angle a to the opening 7 and/or a plane 14 parallel thereto. Accordingly, a longitudinal axis 10, which is arranged along the entire length of the loudspeaker housing and is located in the centre of cross-sections of the longitudinal extension, has a deviation from the straight line 12, wherein, in turn, an angle a exists between the longitudinal axis and the straight line 12. Due to the curvature, the outer and inner sound undergo asymmetric acoustic merging such that the sound-amplifying characteristic of the shape of the loudspeaker housing acts over a large frequency range. Also, the roughened or textured or contoured inner surface (see structures 15) causes a frequency range extension for the properties of the loudspeaker housing.

Figure 4:
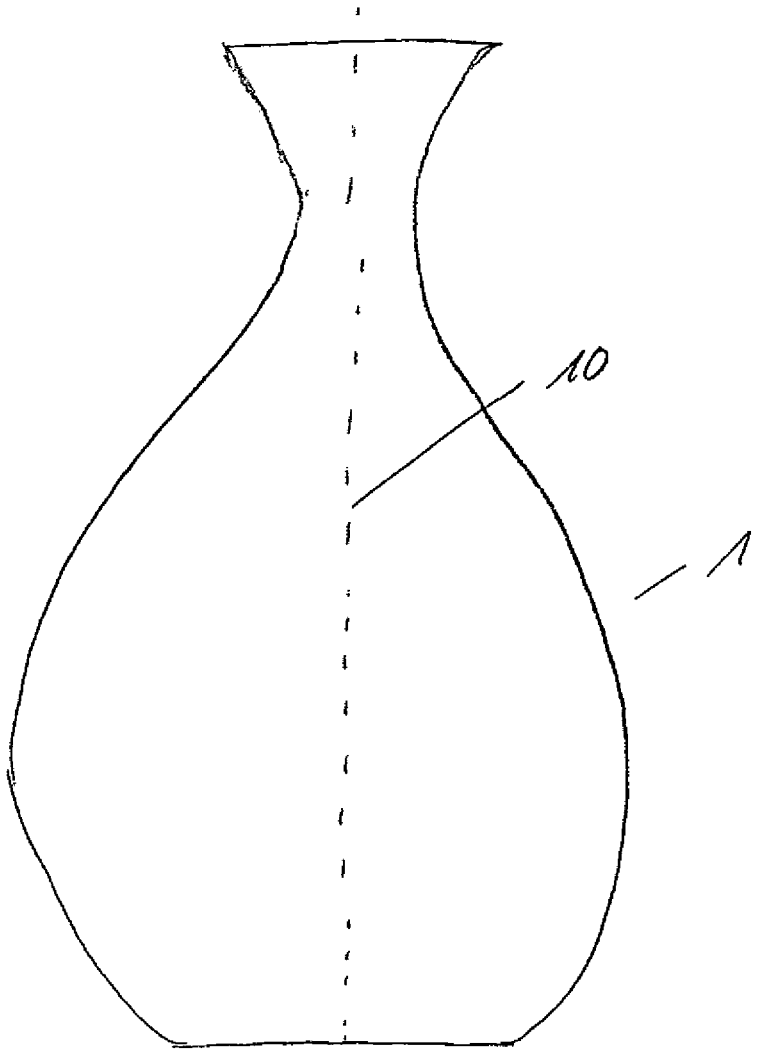

However, an embodiment is also conceivable in which there is provision not for curvature of the housing and/or the longitudinal axis 10, but rather for a rotationally symmetrical configuration of the loudspeaker housing about the longitudinal axis 10. Such an embodiment is shown in FIG. 4.

Although the present invention has been described in detail with reference to the embodiments, it is self-evident to the person skilled in the art that the invention is not limited to these embodiments, but rather that modifications involving the omission of individual characteristics are possible, or that other types of combinations of characteristics can be made without departing from the scope of the appended claims. The present disclosure comprises all combinations of the presented individual features.

The invention claimed is:

1. A loudspeaker housing for accommodating a loudspeaker module;

wherein the loudspeaker housing has a sound output side having a sound output opening and a casing;

wherein the sound output side is a side of the loudspeaker housing that is designed for outputting sound of the loudspeaker module when the loudspeaker module is arranged in the loudspeaker housing;

wherein a sound output direction is perpendicular to the sound output side;

wherein the casing is arranged radially around a direction opposite the sound output direction and laterally around the sound output side;

wherein the loudspeaker housing has a rear side opposite the sound output side;

wherein the rear side is open or has an opening;

wherein the casing between the sound output side and the rear side varies in a cross-section thereof perpendicular to a distance line between the sound output side and the rear side;

wherein a rear opening plane of the open rear side or of the opening of the rear side and a rear opening plane of the sound output opening of the sound output side are arranged to each other at an acute angle greater than 0° and smaller than or equal to 90°;

wherein the casing has a barrel-shaped section, a tapered section, and a conical expansion section; and wherein the loudspeaker housing has a longitudinal axis, which runs from the sound output side to the rear side, and the cross-section is perpendicular to the longitudinal axis, with the longitudinal axis being located in a center of the cross-section and wherein the longitudinal axis is curved.

2. Loudspeaker housing in accordance with claim 1, wherein the casing is cylindrical or curved around the sound output side.

3. Loudspeaker housing in accordance with claim 1, wherein the distance line between the sound output side and the rear side is greater than a greatest diameter of the casing perpendicular to the distance line between the sound output side and the rear side.

4. Loudspeaker housing in accordance with claim 1, wherein the casing between the sound output side and the rear side has several sections.

5. Loudspeaker housing in accordance with claim 1, wherein the barrel-shaped section is on the sound output side, the conical expansion section is on the rear side with an outwardly expanding cone, and the tapered section is arranged between the barrel-shaped section and the conical expansion section.

6. Loudspeaker housing in accordance with claim 1, wherein the tapered section is a hyperboloid.

7. Loudspeaker housing in accordance with claim 1, wherein transitions between the sections are continuous and/or flowing.

8. Loudspeaker housing in accordance with claim 1, wherein the rear side and the sound output side are arranged at an acute angle greater than 0° and smaller than or equal to 90°.

9. Loudspeaker housing in accordance with claim 1, wherein an inside of the loudspeaker housing has a smooth and/or textured surface.

10. Loudspeaker housing in accordance with claim 1, wherein the loudspeaker housing is formed of plastic, of carbon-fibre-reinforced plastic, of plastic to which natural or mineral materials have been added, of natural substances or of natural composite materials.

11. Loudspeaker with a loudspeaker housing;

wherein the loudspeaker housing has a sound output side having a sound output opening and a casing;

wherein the sound output side is a side of the loudspeaker housing that is designed for outputting a sound of a loudspeaker module when the loudspeaker module is arranged in the loudspeaker housing;

wherein a sound output direction is perpendicular to the sound output side;

wherein the casing is arranged radially around a direction opposite the sound output direction and laterally around the sound output side;

wherein the loudspeaker housing has a rear side opposite the sound output side;

wherein the rear side is open or has an opening;

wherein the casing between the sound output side and the rear side varies in a cross-section thereof perpendicular to a distance line between the sound output side and the rear side;

wherein a rear opening plane of the open rear side or of the opening of the rear side and a front opening plane of the sound output opening of the sound output side are arranged to each other at an acute angle greater than 0° and smaller than or equal to 90°; and wherein the loudspeaker module is arranged in a region of the sound output side.

12. Method for the manufacture of a loudspeaker housing;

providing the loudspeaker housing with a sound output side having a sound output opening and a casing;

wherein the sound output side is a side of the loudspeaker housing that is designed for outputting a sound of the loudspeaker module when the loudspeaker module is arranged in the loudspeaker housing;

wherein a sound output direction is perpendicular to the sound output side;

wherein the casing is arranged radially around a direction opposite the sound output direction and laterally around the sound output side;

wherein the loudspeaker housing has a rear side opposite the sound output side;

wherein the rear side is open or has an opening;

wherein the casing between sound output side and the rear side varies in a cross-section thereof perpendicular to a distance line between the sound output side and the rear side;

wherein a rear opening plane of the open rear side or of the opening of the rear side and a front opening plane of the sound output opening of the sound output side are arranged to each other at an acute angle greater than 0° and smaller than or equal to 90°; and wherein dimensions and/or shape of the loudspeaker housing are chosen in accordance with desired properties of the loudspeaker.

* * * * *